US007806986B2

(12) United States Patent
Ueebisu

(10) Patent No.: US 7,806,986 B2
(45) Date of Patent: Oct. 5, 2010

(54) SUBSTRATE CLEANING APPARATUS AND SUBSTRATE CLEANING METHOD USING THE SAME

(75) Inventor: Sinji Ueebisu, Kawasaki (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 242 days.

(21) Appl. No.: 11/898,236

(22) Filed: Sep. 11, 2007

(65) Prior Publication Data

US 2008/0066780 A1 Mar. 20, 2008

(30) Foreign Application Priority Data

Sep. 15, 2006 (JP) ..... 2006-250475

(51) Int. Cl.

| | |
|---|---|
| ***B08B 3/00*** | (2006.01) |
| ***B08B 3/02*** | (2006.01) |
| ***B08B 3/04*** | (2006.01) |
| ***B08B 11/02*** | (2006.01) |
| ***B08B 1/02*** | (2006.01) |
| ***B08B 1/04*** | (2006.01) |

(52) U.S. Cl. ..... 134/16; 134/9; 134/15; 134/32

(58) Field of Classification Search ..... 15/88.3, 15/207.2; 134/9, 16

See application file for complete search history.

(56) References Cited

U.S. PATENT DOCUMENTS 2,465,396 A * 3/1949 Peterson et al. ..... 15/206
6,401,813 B1 * 6/2002 Carmichael et al. ..... 166/173

FOREIGN PATENT DOCUMENTS

| | | | |
|---|---|---|---|
| JP | 5-198544 | | 8/1993 |
| JP | 06-190346 | | 7/1994 |
| JP | 01981969 | | 2/1995 |
| JP | 2000-060641 | * | 2/2000 |
| JP | 2006-184388 | | 7/2006 |
| JP | 2006-239503 | | 9/2006 |

OTHER PUBLICATIONS

Korean Patent Office issued a Korean Office Action dated Dec. 12, 2008.

* cited by examiner

*Primary Examiner*—Michael Kornakov
*Assistant Examiner*—Natasha Campbell
(74) *Attorney, Agent, or Firm*—Young & Thompson

(57) ABSTRACT

Disclosed is a substrate cleaning apparatus including a brush cleaning unit which cleans a substrate by making a roll brush in contact with a surface of the substrate, and a transporting unit which conveys the substrate. The roll brush includes a bristle. At least one of a diameter of the roll brush, stiffness of the bristle, and density of the bristle becomes larger from an end portion of the roll brush to a central portion thereof.

1 Claim, 9 Drawing Sheets

SUBSTRATE CLEANING APPARATUS AND SUBSTRATE CLEANING METHOD USING THE SAME

INCORPORATION BY REFERENCE

This application is based upon and claims the benefit of priority from Japanese Patent Application No. 2006-250475 filed on Sep. 15, 2006, the disclosure of which is incorporated herein in its entirety by reference.

BACKGROUND OF THE INVENTION

1. Technical Field

The present invention relates to a production unit for a liquid crystal display panel and a manufacturing method for a liquid crystal display panel and in particular, relates to a substrate cleaning apparatus for cleaning a substrate included in a liquid crystal display panel and a substrate cleaning method using the same.

2. Background Art

As a display device of audio and visual (AV) equipment or an office automation (OA) equipment, a liquid crystal display device is used widely, since the device is thin, light in weight and low power consuming. This liquid crystal display (LCD) device includes an LCD panel including a first substrate, a second substrate and a liquid crystal (LC) layer disposed between the two substrates. Switching elements such as thin film transistors (TFTs) are formed in a matrix shape on the first substrate (hereinafter, referred to as a TFT substrate). A color filter (CF) and a black matrix (BM) or the like are formed on the second substrate (hereinafter, referred to as a CF substrate).

The above-mentioned LCD panel is formed in following procedures, for example, (1) cleaning a TFT substrate and a CF substrate, and drying them;

(2) printing/curing alignment films on surfaces of the TFT substrate and the CF substrate facing each other;

(3) rubbing the alignment film;

(4) cleaning the substrates, and drying in order to remove fibers of rubbing cloth or shavings of the alignment film;

(5) spraying one of the TFT substrate and the CF substrate with spacers, and fixing the spacers;

(6) applying a sealing material and a transfer material on the other substrate; and (7) dropping a liquid crystal material and sealing the substrates.

In the above-mentioned LCD panel, an alignment direction of an LC molecule is controlled by an electric field which electrodes provided on either or both of the substrates generate. The above-mentioned LCD panel displays images based on the control. When foreign objects remain on the TFT substrate or the CF substrate, a gap between the substrates is formed nonuniformly. Due to the gap being nonuniform, displaying quality deteriorates. Accordingly, cleaning of a substrate is important particularly for a large LCD panel. Thus, large substrate cleaning has been performed using various kinds of methods.

In a substrate cleaning apparatus, a substrate is conveyed in horizontal direction one-by-one. As a cleaning method using the substrate cleaning apparatus, a spray method, a brush method, a combination of the methods or the like are known. In the spray method, purified water or chemicals are sprayed on a substrate. In the brush method, a roll brush mechanically removes foreign objects. In the substrate cleaning apparatus, when a rear face of a glass substrate is cleaned, the substrate receives an upward pressure from the rear face. Therefore, the glass substrate is conveyed, while suppressing the upward pressure to the glass substrate (as for an example of a substrate cleaning apparatus of the above-mentioned brush method, for example, refer to Japanese Patent Application Laid-Open No. 1993-198544 (2-4 pages and FIG. 1)).

Since removing foreign objects mechanically by the roll brush, the brush method works excellently. However, even the method may be insufficient in cleaning the rear face of the substrate. The difficulties are described with reference to FIGS. 9, 10A and 10B. FIG. 9 is a side view which illustrates a configuration of a typical brush cleaning unit. FIG. 10A shows a typical roll brush. FIG. 10B shows that a roll brush is cleaning the rear face of the glass substrate.

As shown in FIG. 9, the brush cleaning unit 1 includes a brush cleaning mechanical section, a spray cleaning mechanical section and a transporting mechanical section. The brush cleaning mechanical section includes a roll brush 10 which touches the rear face of the glass substrate 3 while rotating, and a roll brush moving section 7 which moves the roll brush 10 up and down. The spray cleaning mechanical section includes an upper spray 6*a* which sprays purified water or chemicals from jet orifices arranged over the glass substrate 3 to clean a front face thereof. The spray cleaning mechanical section further includes a lower spray 6*b* which sprays purified water or chemicals from jet orifices arranged below the glass substrate 3 to clean the rear face thereof. The transporting mechanical section includes a conveyance roller 4 which moves the glass substrate 3 in a direction perpendicular to longitudinal of the roll brush 10, and a rising preventing roller 5 which prevents the glass substrate 3 from rising.

SUMMARY

An exemplary object of the invention is to provide a production unit of an LCD panel which cleans an entire substrate uniformly without giving an excessive stress to a substrate as a cleaning target, and a manufacturing method for an LCD panel using the same.

A substrate cleaning apparatus according to an exemplary aspect of the present invention includes a brush cleaning unit which cleans a substrate by making a roll brush in contact with a surface of the substrate, the roll brush including a bristle, and at least one of a diameter of the roll brush, stiffness of the bristle, and density of the bristle becoming larger from an end potion of the roll brush to a central portion thereof, and a transporting unit which conveys the substrate.

Other exemplary features and advantages of the present invention will be apparent from the following description taken in conjunction with the accompanying drawings, in which like reference characters designate the same or similar parts throughout the figures thereof.

BRIEF DESCRIPTION OF THE DRAWINGS

Exemplary features and advantages of the present invention will become apparent from the following detailed description when taken with the accompanying drawings in which.

EXEMPLARY EMBODIMENT

Exemplary embodiments will now be described in detail in accordance with the accompanying drawings.

In a preferred exemplary embodiment, a substrate cleaning apparatus includes a brush cleaning unit, a spray cleaning unit and a transporting unit. The brush cleaning unit includes a roll brush which touches a glass substrate as a cleaning target while rotating, and a brush moving section that moves the roll brush up and down. The spray cleaning unit includes an upper spray and a lower spray which spray water or chemicals to a glass substrate. The transporting unit includes a conveyance roller for conveying a glass substrate and a rising prevention roller for preventing rising of the substrate. Even if the glass substrate warps in a direction opposite to the roll brush to be convex, the roll brush is formed so that contact pressure put on the concave substrate may become uniform. That is, the roll brush is formed so that a diameter thereof may become large, or stiffness or density of bristles may become large, from an end portion in a longitudinal of the roll brush to a central portion therein. As a result, the contact pressure of the roll brush applied on the concave surface of the glass substrate becomes uniform. The whole glass substrate surface can be cleaned uniformly without an excessive stress to the glass substrate. Hereinafter, the substrate cleaning apparatus will be described in detail with reference to drawings.

Embodiment 1

Figure 1:
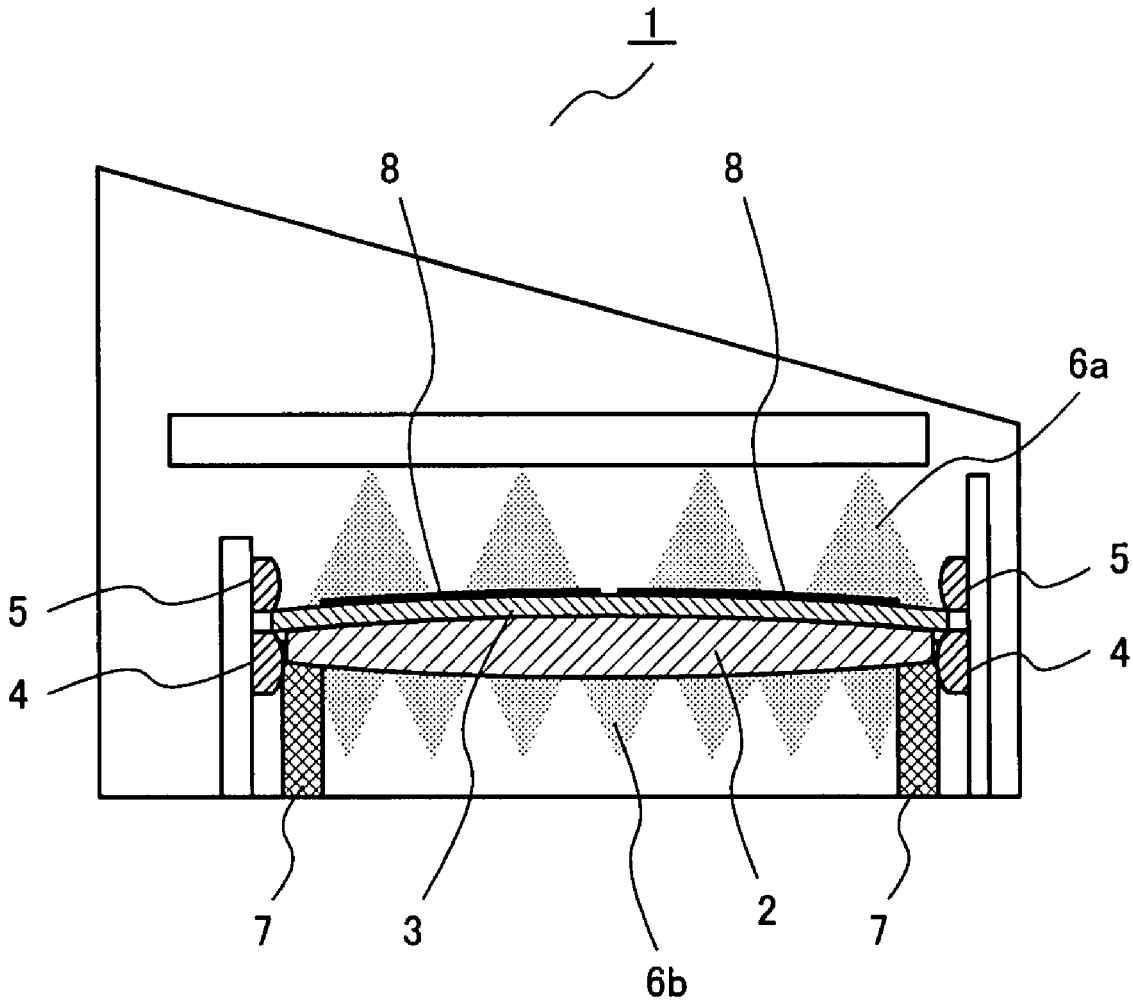
FIG. 1 is a side view showing a configuration of a brush cleaning unit according to a first exemplary embodiment of the present invention.
Figure 2A:
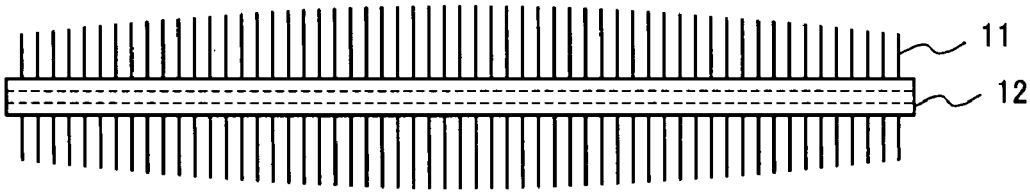
FIGS. 2A to 2C are sectional views showing an example of a roll brush according to the first exemplary embodiment of the present invention.
Figure 2B:
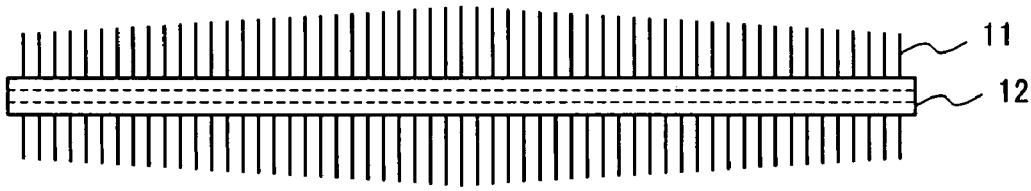
Figure 2C:
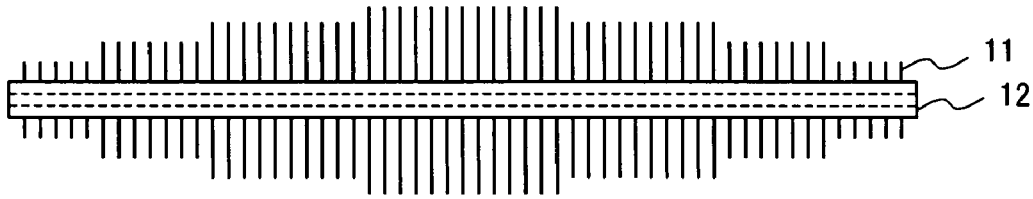
Figure 2D:
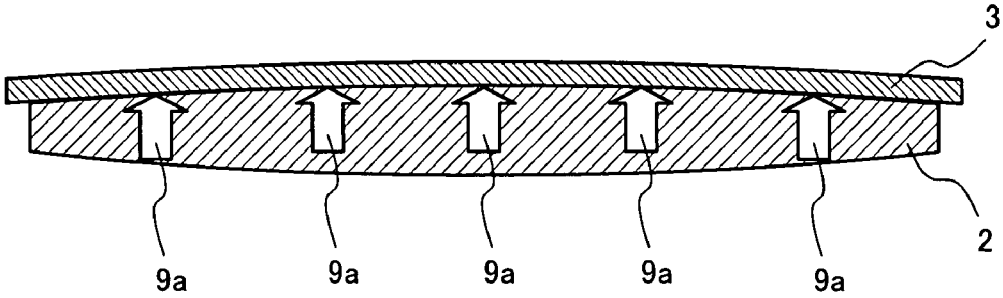
FIG. 2D is a sectional view of a roll brush touching a glass substrate.
Figure 3:
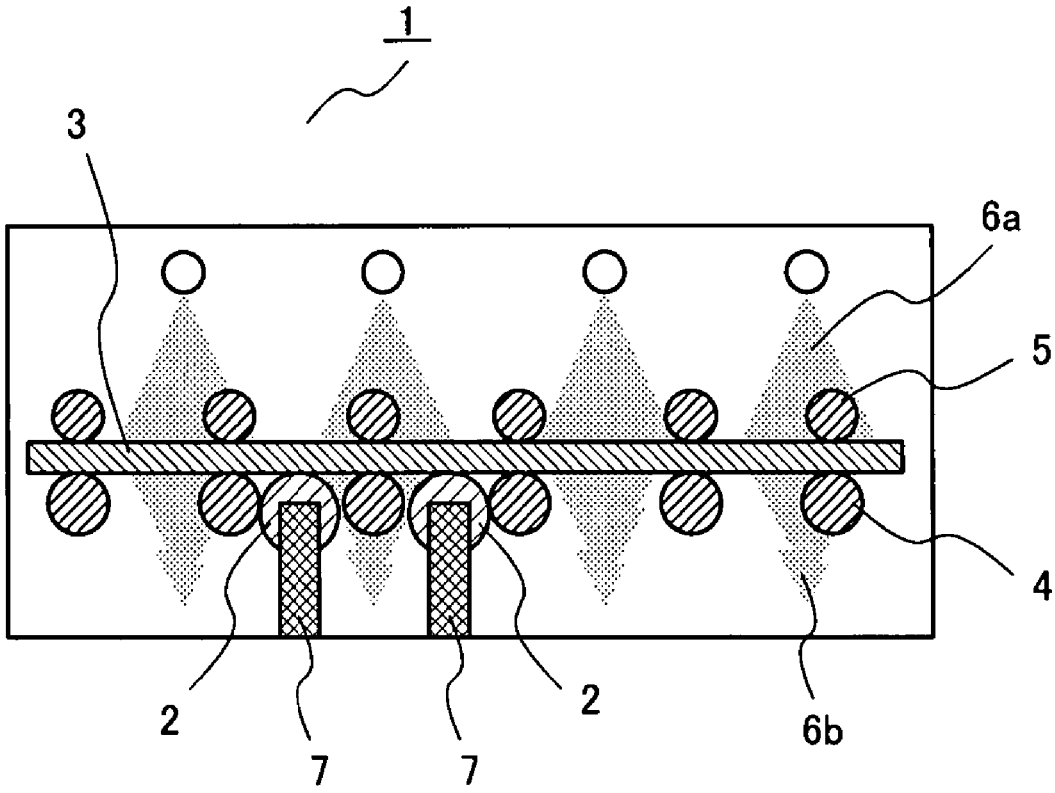
FIG. 3 is a side view of the brush cleaning unit in a longitudinal direction of the roll brush according to the first exemplary embodiment of the present invention.
Figure 4:
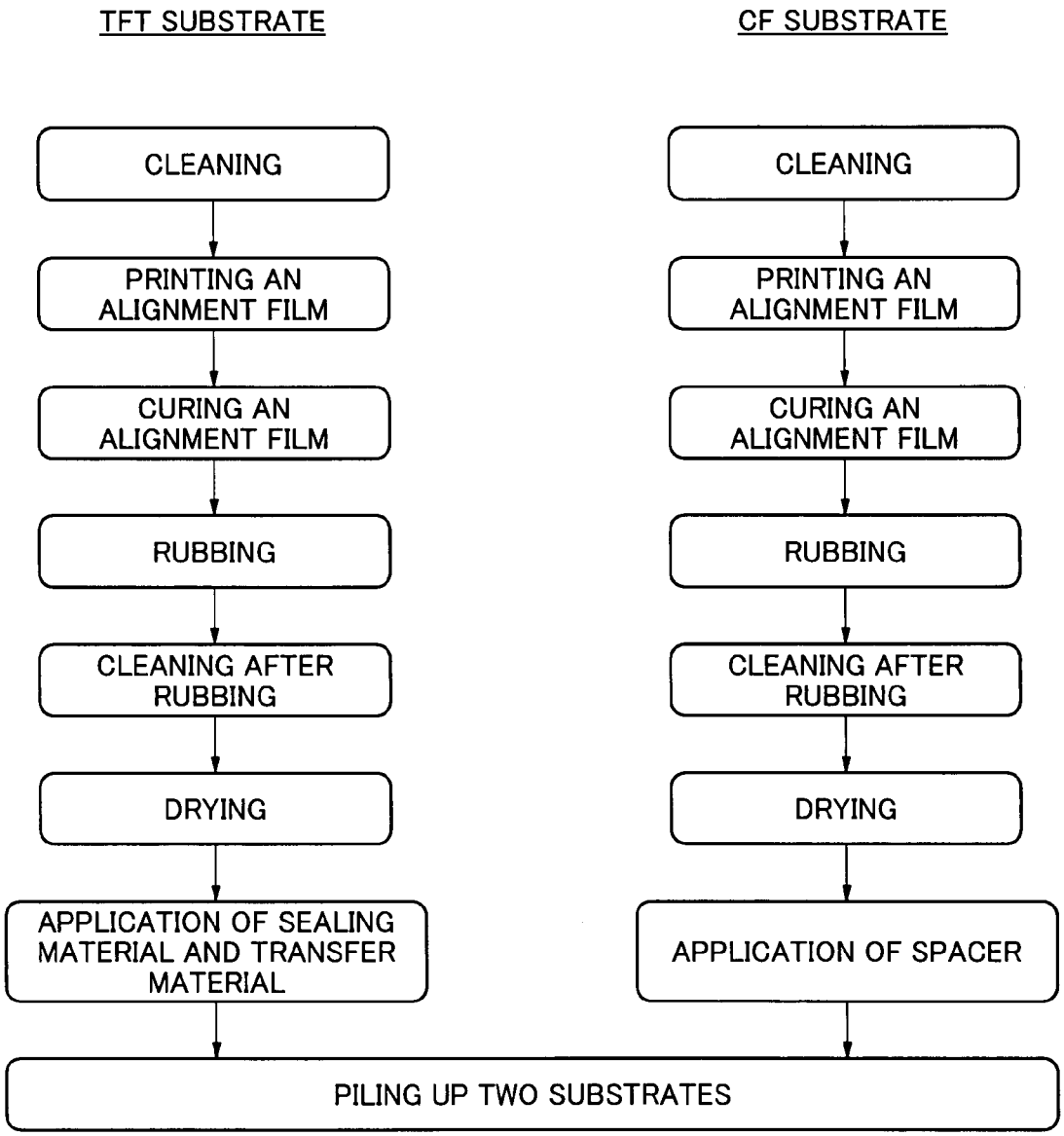
FIG. 4 is a flow chart showing a manufacturing procedure of an LCD panel.
Figure 5:
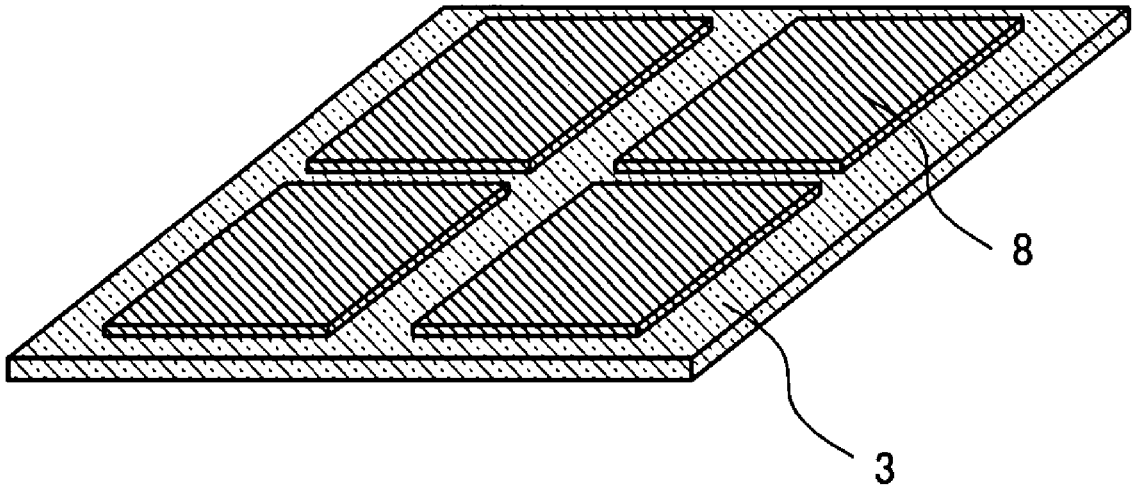
FIG. 5 is a perspective view showing an exemplary configuration of a glass substrate as a cleaning target.

First, a substrate cleaning apparatus and a substrate cleaning method according to a first exemplary embodiment will be described with reference to FIGS. 1 to 5. FIG. 1 is a side view showing a configuration of the brush cleaning unit of the glass substrate cleaning apparatus. FIGS. 2A to 2C are sectional views showing an example of the roll brush. FIG. 2D is a sectional view showing a state that the roll brush is touching a glass substrate. FIG. 3 is a side view of the brush cleaning apparatus. FIG. 4 is a flow chart showing a manufacturing procedure for an LCD panel. FIG. 5 is a perspective view showing an exemplary configuration of the glass substrate which becomes a cleaning target.

Generally, an LCD panel included in an LCD device includes a TFT substrate in which switching elements such as thin film transistors are formed in a matrix shape, and a CF substrate in which a color filter, a black matrix and the like are formed. An alignment film to which orientation treatment (i.e. rubbing treatment) is performed is formed on each of opposed faces of these substrates. Insulating spacers such as polymer beads or silica beads with the predetermined shapes are arranged between the two substrates to form a predetermined gap. And a liquid crystal material is sealed in the gap. In the LCD panel, an alignment direction of LC molecules is controlled by an electric field generated by electrodes formed in at least one substrate. As a result, the LCD panel displays an image.

Here, in order to hold high quality and high yield of an LCD panel, it is necessary to carry out processes, without adhering contaminant to a surface of the substrate. In a cleaning process, it is important to clean an entire substrate uniformly without excessive stress to an LCD panel in a cleaning step particularly after rubbing. Accordingly, in an exemplary embodiment, the brush cleaning apparatus 1 as shown in FIG. 1 and FIG. 3 is used.

The brush cleaning apparatus 1 includes a brush cleaning unit, a spray cleaning unit and a transporting unit. The brush cleaning unit includes a roll brush 2 in which a central part thereof is slightly convex shaped and an moving unit 7 that moves the roll brush 2 up and down. The spray cleaning unit includes an upper spray 6*a* and a lower spray 6*b* which spray water or chemicals from jet orifices (not shown) provided in a upper side and a lower side of the glass substrate 3. The transporting unit includes a conveyance roller 4 which conveys the glass substrate 3 and a rising prevention roller 5 which prevents the substrate from rising. As shown in FIG. 2A, the above-mentioned roll brush 2 includes a shaft 12 which rotates around a rotary shaft and a bristle 11 planted around the shaft 12. For example, a bristle 11 includes polypropylene, polyvinyl chloride or the like which is formed in a thin line shape or in a strip shape.

Next, operation of the brush cleaning unit 1 will be described. As shown in FIG. 5, a cleaning step after rubbing in an LCD panel manufacturing process shown in FIG. 4 is performed after forming an alignment film 8 on the surface of the glass substrate 3. While a surface of the glass substrate 3 is cleaned, both ends of the glass substrate 3 are held with the rising prevention roller 5 in order to prevent the glass substrate 3 from rising in both ends thereof. However, both of water pressure of the lower spray 6*b* and the rotating roll brush 2 push the glass substrate 3 upward, though only water pressure of the upper spray 6*a* pushes the glass substrate 3 downward. Thus upward pressure on the glass substrate 3 is greater than that of downward pressure thereto. As a result, the glass substrate 3 is transformed to be convex upward.

Accordingly, in the exemplary embodiment, as shown in FIG. 2A, the roll brush 2 is formed so that a diameter may become large from edge portions of the roll brush 2 to a central portion thereof. As shown in FIG. 2D, when such roll brush 2 touches the glass substrate 3, uniform contact pressure 9A may be generated. In the cleaning step after rubbing, since it is possible to clean the glass substrate 3 under proper pressure well, the alignment film 8 on the surface of the glass substrate 3 is not damaged. In the case, if contact pressure of the roll brush 2 is properly adjusted by a roll brush moving section 7, optimal cleaning effect is obtained. Further, in order to change the diameter of the roll brush 2, for example, it is possible to change at least one of a length of the bristle of the roll brush 2 and a diameter of the shaft thereof.

Thus, even when the glass substrate 3 warps to be convex upward due to contacting pressure of the roll brush 2, the roll brush 2 contacts, by uniform pressure, all over the glass substrate 3 irrespective of a shape thereof. As a result, the contact pressure 9A becomes uniform as shown in FIG. 2D, and the glass substrate 3 is cleaned uniformly.

A change in the diameter of the roll brush 2 in a longitudinal direction can be applied suitably, according to stiffness and density of the brush bristle, thickness and composition of the glass substrate 3, holding power of the rising prevention roller 5, spraying power of the upper spray 6*a* and the lower spray 6*b*, etc. In FIGS. 2A and 2D, the diameter of roll brush 2 may change in the longitudinal direction in an arc line. The diameter thereof may change linearly as shown in FIG. 2B. As shown in FIG. 2C, the diameter thereof may change in a stepwise manner.

Embodiment 2

Figure 6A:
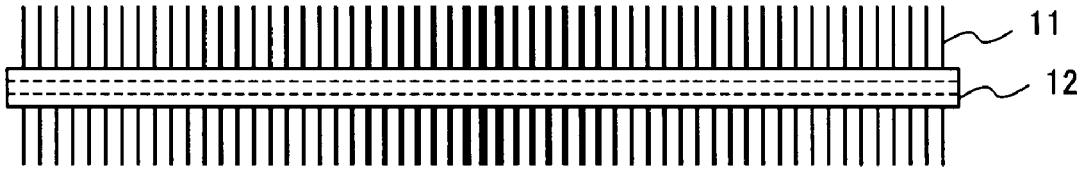
FIG. 6A is a sectional view of a roll brush according to a second exemplary embodiment of the present invention typically.
Figure 6B:
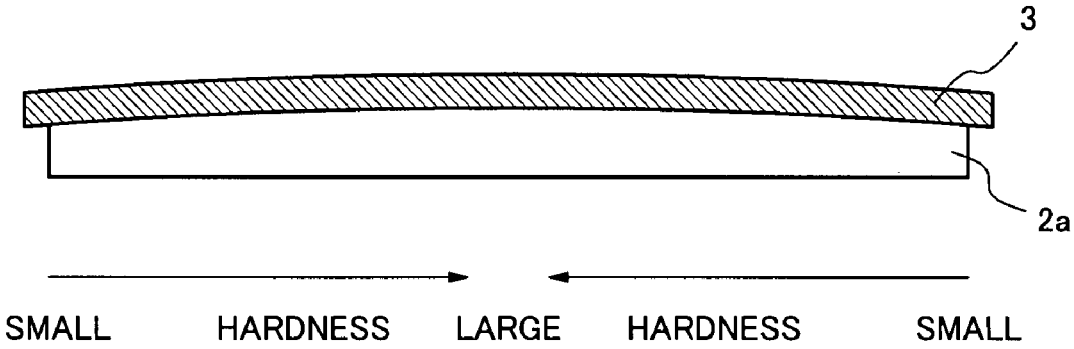
FIG. 6B is a figure showing a roll brush touching a glass substrate.
Figure 7A:
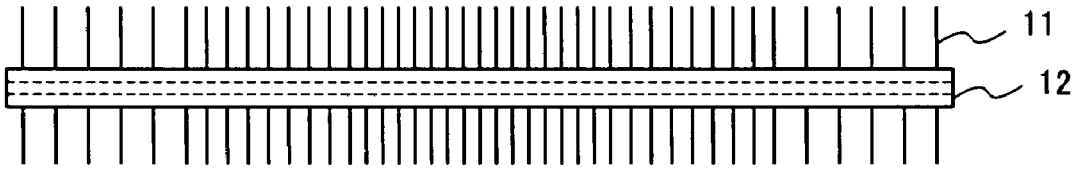
FIG. 7A is a sectional view of a roll brush according to the second exemplary embodiment of the present invention typically.
Figure 7B:
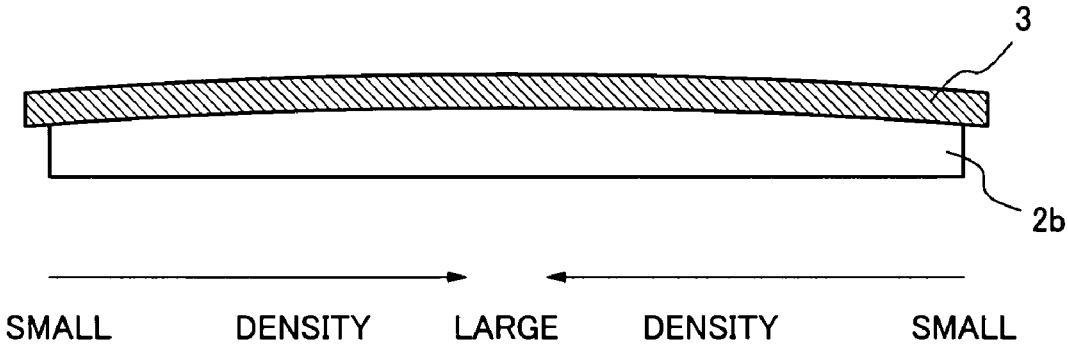
FIG. 7B is a figure showing a roll brush touching a glass substrate.
Figure 8:
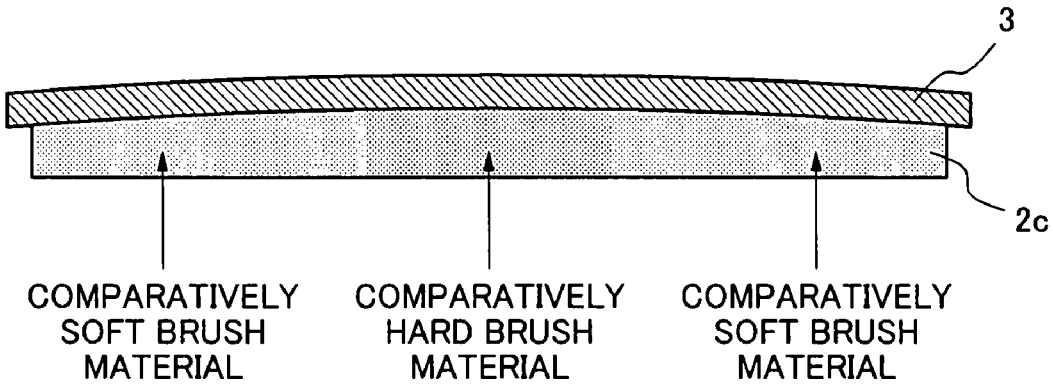
FIG. 8 is a figure showing a roll brush touching a glass substrate according to the second exemplary embodiment of the present invention.
Figure 9:
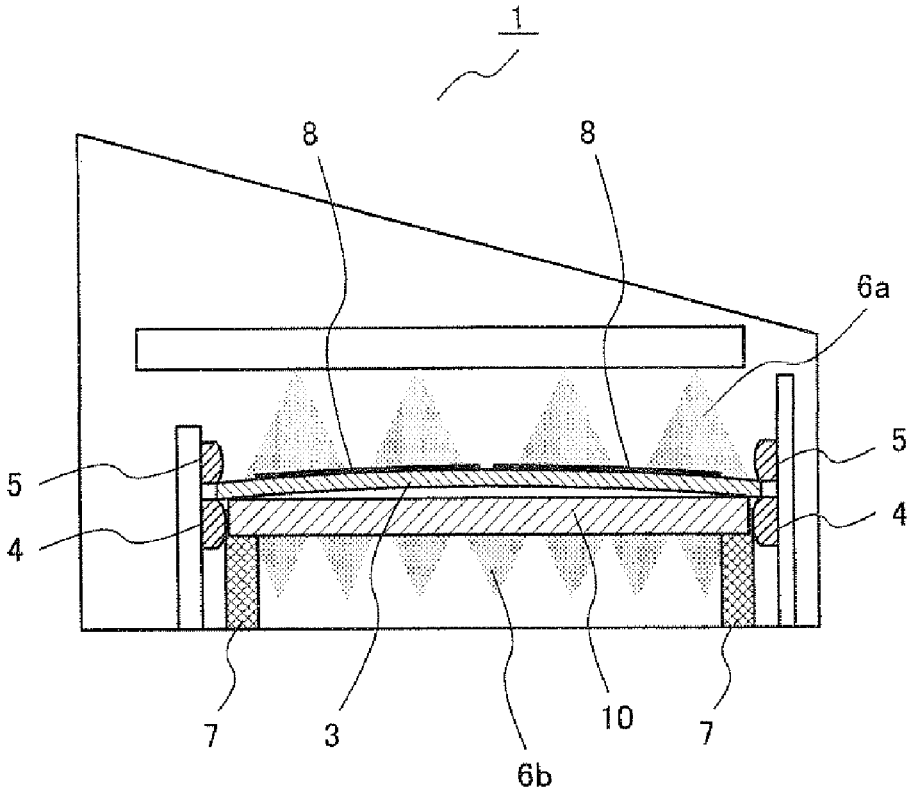
Fig.9 Prior Art
FIG. 9 is a side view showing a configuration of a brush cleaning unit used by a related art.

Next, a substrate cleaning apparatus and a substrate cleaning method according to a second exemplary embodiment will be described with reference to FIGS. 6A to 8. FIG. 6A and FIG. 7A are sectional views showing a roll brush typically. FIGS. 6B, 7B and 8 show a roll brush contacting a glass substrate.

In the first embodiment, the diameter of the roll brush changes in a longitudinal direction. In the second exemplary embodiment, when at least one of stiffness, a density, and material of the roll brush changes in the longitudinal direction of the roll brush, a cleaning effect on the surface of the substrate is improved.

For example, in order to uniformly arrange stress (i.e. contacting pressure) to the surface of the glass substrate, as shown in FIGS. 6A and 6B, a roll brush 2*a* is formed so that stiffness of bristles may become large from edges of the roll brush 2*a* to a central portion thereof. Thereby, the same cleaning effect as that of the first exemplary embodiment is obtained. Specifically, bristles made of polypropylene, vinyl chloride, or the like having a thin line shape or a strip shape are planted on a surface of a shaft of the roll brush 2*a*. A diameter, a thickness or a width of the bristle is small at edge portions, and large at a central portion of the roll brush 2*a*. The bristles having large diameter or thickness are stiffer than the bristles having small diameter or thickness. When the roll brush 2*a* contacts the glass substrate 3, the glass substrate 3 warps and becomes convex upward. However, even when the stiffer bristles contact the central portion of the rear surface of the upward convex substrate with small pressure, the stiffer bristles exercise the same cleaning ability as that of the bristles located at edge portions of the roll brush 2*a*.

As shown in FIGS. 7A and 7B, the roll brush 2*b* is arranged so that density of bristles may become higher from the edge portions of the roll brush 2*b* to the central portion thereof. As a result, the same cleaning effect as that of the first exemplary embodiment is obtained. Specifically, bristles are planted roughly at edges of the roll brush 2*b* and are planted densely at the central portion thereof. When the roll brush 2*a* contacts the glass substrate 3, the glass substrate 3 warps and becomes convex upward. However, even when the dense bristles contact a central portion of a rear surface of the upward convex substrate 3 with small pressure, the dense bristles portion exercise the same cleaning ability as that of thin bristles portion located at edge portions of the roll brush 2*a*.

As shown in FIG. 8, bristles of a roll brush 2*c* are formed so that stiffness of bristles may become large from edges of the roll brush 2*c* to a central portion thereof. In the case, though one of a diameter, a thickness and a width of the bristle is constant, a material of the bristles is different. Bristles arranged at central portion of the roll brush 2*c* are made of stiffer material than that of bristles arranged at edge portions thereof. When the roll brush 2*c* contacts the glass substrate 3, the glass substrate 3 warps and becomes convex upward. However, even when the stiffer bristles contact the central portion of the rear surface of the upward convex substrate with small pressure, the stiffer bristles exercise the same cleaning ability as that of the bristles located at edge portions of the roll brush 2*c*.

Thus, the roll brushes 2*a* and 2*b* are formed so that stiffness or density of bristles may become large from the edge part to the central part, or as the roll brush 2*c*, relatively stiff bristle is used at the central part and a relatively soft bristle is used at the edge part. As a result, a whole substrate surface is cleaned uniformly without giving an excessive stress to the substrate.

Figure 10A:
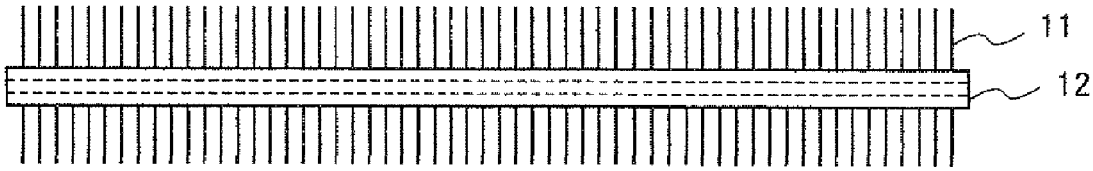
Fig.10A Prior Art
FIG. 10A is a diagram showing a roll brush used by the related art.
Figure 10B:
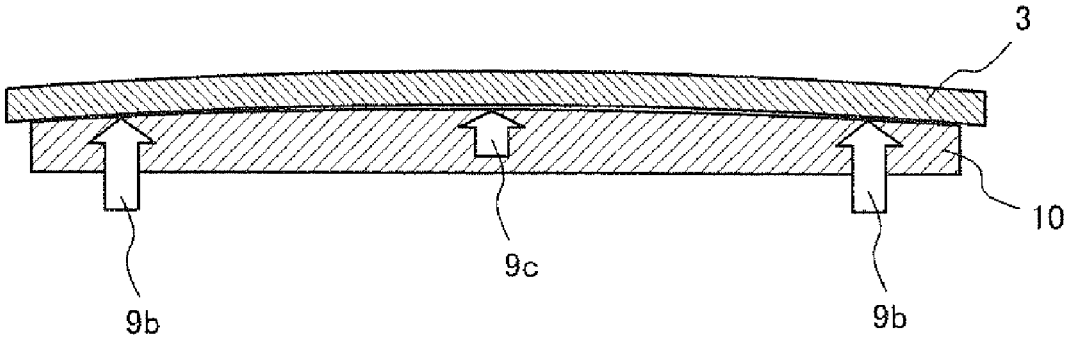
Fig.10B Prior Art
FIG. 10B is a diagram showing a state that a roll brush of related art is touching a glass substrate.

The related art described in the background art causes a problem that when cleaning the rear face of the glass substrate 3 in the brush method using the brush cleaning unit 1, the roll brush 10 touches the rear face of the glass substrate 3 with proper pressure in order to clean the rear face well. As a result, the downward pressure on the front face of the glass substrate 3 is smaller than the upward pressure from the rear face thereof due to the contact pressure of the roll brush 10. However, only an edge of the glass substrate 3 is held by the conveyance roller 4 and the rising preventing roller 5. The glass substrate 3 transforms to be convex upward. On the other hand, as shown in FIG. 10A, a diameter of the roll brush 10 keeps constant over a total length thereof. Accordingly, as shown in FIG. 10B, contact pressure 9*b* at the edge portion of the glass substrate 3 becomes greater than contact pressure 9*c* at a central portion thereof. Thus the central portion of the glass substrate 3 is not sufficiently cleaned compared with the edge portion.

If the contact pressure is increased in order to clean well the central portion of the glass substrate 3, the contact pressure in the edge portion becomes excessively large. And transformation of the glass substrate 3 becomes large to increase a stress applied on the glass substrate 3. As a result, disorder of an alignment direction in an alignment film, malfunction of a TFT, or the like which deteriorates an image quality of the LCD panel would occur.

Above-mentioned difficulty becomes quite crucial when cleaning a large and thin glass substrate, in particular, at cleaning step after performing film (i.e. alignment film) processing on a surface of the glass substrate 3.

An exemplary advantage according to the invention is that the roll brush can uniformly contact the surface of a convex substrate which warped in a direction opposite to the roll brush. An entire substrate is cleaned uniformly without an excessive stress to the substrate.

Another advantage is that the roll brush can form homogeneous cleaning ability over the whole surface of the convex substrate to perform homogeneous cleaning, if relatively stiff or dense bristles are provided at a center region of a total length of the roll brush.

Further, in each above-mentioned embodiment, a TFT substrate and a CF substrate included in an LCD panel are cleaned. The present application is not limited to the above-mentioned embodiment, and it can be applied similarly to cleaning of arbitrary substrates. The present application is also applicable to a case where a top surface of a substrate may contact a roll brush and be cleaned similarly.

The present application is available in an optional substrate cleaning apparatus and a substrate cleaning method which clean a substrate by a roll brush. In particular, the present application is available in a production unit of a liquid crystal display panel and a manufacturing method of a liquid crystal display panel used for cleaning of a color filter manufacturing, cleaning in a photo process (PR) step of a TFT manufacturing and cleaning after panel rubbing of a substrate.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

Further, it is the inventor's intention to retain all equivalents of the claimed invention even if the claims are amended during prosecution.

What is claimed is:

1. A substrate cleaning method using a substrate cleaning apparatus, the substrate cleaning apparatus including, a brush cleaning unit which cleans a substrate by making a roll brush in, contact with a surface of the substrate, and a transporting unit which conveys the substrate, the roll brush including a bristle, and at least one of a diameter of the roll brush, stiffness of the bristle, and density of the bristle becoming larger from an end portion of the roll brush to a central portion thereof, the substrate cleaning method comprising:

pressing the roll brush to the substrate with a predetermined pressure, the roll brush rotating; and contacting the surface of the substrate with the roll brush with a uniform pressure; and deforming the surface of the substrate according to the contact with the roll brush; and spraying a predetermined fluid to the substrate, which is held by a holding means.

* * * * *